US007454877B2

(12) United States Patent
Morrison

(10) Patent No.: US 7,454,877 B2
(45) Date of Patent: Nov. 25, 2008

(54) TENSION CONTROL SYSTEM AND METHOD FOR TENSIONING A STRAPPING MATERIAL AROUND A LOAD IN A STRAPPING MACHINE

(75) Inventor: Arland Morrison, Port Barrington, IL (US)

(73) Assignee: Illinois Tool Works Inc., Glenview, IL (US)

( * ) Notice: Subject to any disclaimer, the term of this patent is extended or adjusted under 35 U.S.C. 154(b) by 69 days.

(21) Appl. No.: 11/535,372

(22) Filed: Sep. 26, 2006

(65) Prior Publication Data

US 2008/0072539 A1 Mar. 27, 2008

(51) Int. Cl.
*B65B 13/22* (2006.01)

(52) U.S. Cl. ..... 53/64; 53/589; 100/4; 100/26; 100/29; 100/32

(58) Field of Classification Search ..... 53/582, 53/589, 64; 100/4, 26, 29, 32; *B65B 13/22*
See application file for complete search history.

(56) References Cited

U.S. PATENT DOCUMENTS 3,759,169 A 9/1973 Goodley
4,575,994 A * 3/1986 Takami ..... 53/582
4,633,152 A * 12/1986 Farr ..... 318/257
4,770,065 A * 9/1988 Woyton ..... 477/44
4,952,270 A 8/1990 Sakaki et al.
4,955,180 A * 9/1990 Sakaki et al. ..... 53/399
5,003,252 A * 3/1991 Nystrom ..... 324/772
5,083,412 A * 1/1992 Sakaki et al. ..... 53/399
5,146,847 A * 9/1992 Lyon et al. ..... 100/2
5,467,701 A * 11/1995 Bartzick et al. ..... 100/4
5,615,538 A * 4/1997 Miyashita et al. ..... 53/589

(Continued)

OTHER PUBLICATIONS

European Search Report dated Aug. 11, 2008 for EP07015880.

*Primary Examiner*—Stephen F Gerrity
(74) *Attorney, Agent, or Firm*—Mark W. Croll; Donald J. Breh; Levenfeld Pearlstein, LLC

(57) ABSTRACT

A strapping machine is provided to feed a strap around a load, position, tension and seal the strap around the load. The strapping machine includes a surface to support the load in the strapping machine; a strap chute to carry a strap around the load and release the strap from the strap chute; a motor assembly to convey the strap around the strap chute, retract the strap material around the load, and tension the strap around the load; and an adjustable speed drive capable of receiving a first reference signal and a second reference signal, and configured to actuate the motor assembly to apply a first amount of torque to the strap when receiving the first reference signal and to apply a second amount of torque to the strap when receiving the second reference signal. The strapping machine also includes a controller configured to operate the adjustable speed drive in a first mode while conveying the strap around the strap chute and retracting the strap material around the load, and a second mode while tensioning the strap around the load. In the first mode, the adjustable speed drive actuate the motor assembly to apply the first amount of torque to the strap, and in the second mode, the adjustable speed drive actuates the motor assembly to apply the second amount of torque to the strap.

20 Claims, 4 Drawing Sheets

U.S. PATENT DOCUMENTS 5,651,306 A * 7/1997 Hoshino ..... 100/26
5,916,108 A * 6/1999 Drietz et al. ..... 53/370
6,640,700 B2 * 11/2003 Helland et al. ..... 100/26
6,655,117 B2 * 12/2003 Hoshino ..... 53/589
2002/0144489 A1 * 10/2002 Hoshino ..... 53/589

* cited by examiner

TENSION CONTROL SYSTEM AND METHOD FOR TENSIONING A STRAPPING MATERIAL AROUND A LOAD IN A STRAPPING MACHINE

BACKGROUND OF THE INVENTION

The present invention is directed to a strapping machine. More particularly, the present invention is directed to an improved tension control system for tensioning a strap around a load in a strapping machine.

Strapping machines are in widespread use for securing straps around loads. There are various types of strappers. One type of strapper is a stationary arrangement in which the strapper is stand-alone device that is part of an overall manufacturing of fabrication operation.

In a stand-alone strapper, a strapping head and drive mechanisms (feed and take-up) are typically mounted within a frame. A chute is likewise mounted to the frame, through which the strapping material is fed.

In one known configuration, a strapping head is mounted at about a work surface, and the chute is positioned above the work surface and above the strapping head. Strap material is fed to the strapping head, and is then driven by feed wheels (by a motor) to feed the strap materials through the strapping head and around the chute back to the strapping head. Once the strap material is fed back to the strapping head, a gripping arrangement grips the strap material and the same motor used to feed the strap material around the chute is reversed and the strap material is stripped from the chute and tensioned around the load. The tensioned strap is then gripped by a second part of the gripping arrangement and the motor is turned off. A cutter in the strapping head cuts the tensioned strap (from the source or supply) and the strapping head forms a seal in the strapping material, sealing the strapping material to itself around the bundled load.

Proper strap tension is achieved by various means. Tension can be controlled mechanically by the use of a mechanical clutch. Alternatively, tension can be controlled by varying the voltage to a drive clutch associated with the motor. When the tension applied to the strap overcomes the voltage being sent to the drive clutch, the clutch slips and continues to slip for a predetermined period of time. Once that time expires, tension is considered complete, whereupon the strap material is cut and the motor and clutch are turned off. However this can result in wear on the clutch, and variability in the tension applied to the strap material Accordingly, there exists a need for a more effective and consistent method for tensioning strapping material around a load in a stationary strapper.

BRIEF SUMMARY OF THE INVENTION

The present invention is a tension control system for a strapping machine configured to feed a strap around a load, position, tension and seal the strap material around the load. The tension control system includes a motor assembly, an adjustable speed drive and a controller.

The motor assembly is configured to convey the strap around a strap chute, retract the strap around the load, and tension the strap around the load. The adjustable speed drive includes inputs for receiving a first reference signal and a second reference signal. The adjustable speed drive is capable of actuating the motor assembly to apply a first amount of torque to the strap when receiving the first reference signal and to apply a second amount of torque to the strap when receiving the second reference signal.

The controller is configured to operate the adjustable speed drive in a first mode while conveying the strap around the strap chute and retracting the strap material around the load, and a second mode while tensioning the strap around the load. In the first mode, the adjustable speed drive actuate the motor assembly to apply the first amount of torque to the strap, and in the second mode, the adjustable speed drive actuates the motor assembly to apply the second amount of torque to the strap.

In another aspect, the present invention provides a method for tensioning a strap around a load in a strapping machine. The method includes actuating a motor assembly to apply a first amount of torque in a first direction to convey the strap around a strap chute, actuating the motor assembly to apply the first amount of torque in a second direction to retract the strap around the load, actuating the motor assembly to apply a second amount of torque in the second direction to tension the strap around the load, determining that the second amount of torque has been applied to the strap, and signaling the completion of tensioning to a controller.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
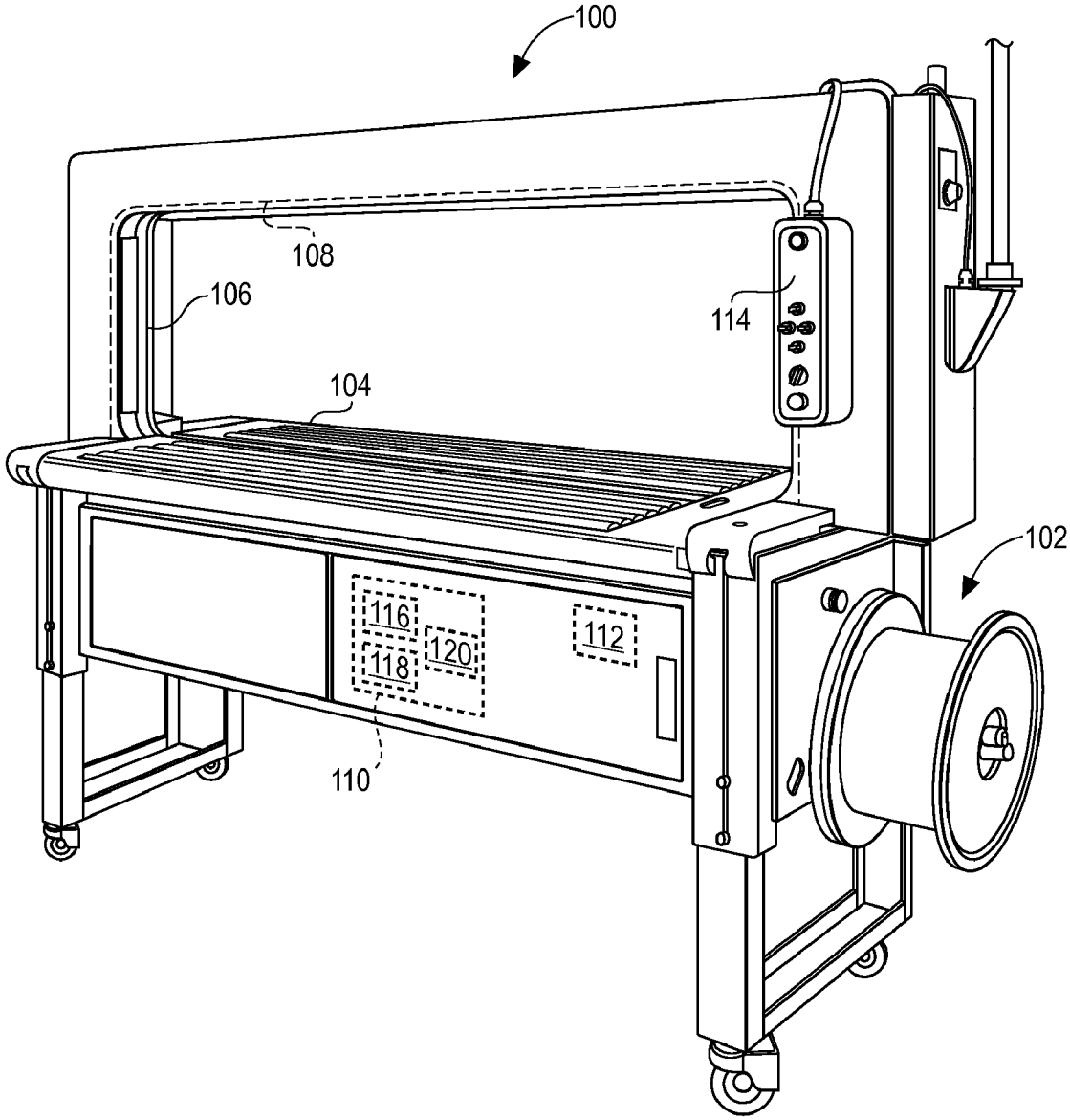
FIG. 1 illustrates a perspective view of one embodiment of a strapping machine.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this specification, namely, "detailed Description of the Invention", relates to a requirement of the United States Patent Office, and does not imply, nor should be inferred to limit the subject matter disclosed herein.

Referring to the figures, and in particular to FIG. 1, there is shown one exemplary embodiment of a strapping machine 100 that may be used with the present invention. Of course, as would be understood by one of ordinary skill in the art, the present invention may be used with various types of strapping machines having various configurations.

The strapping machine 100 includes a frame 102, a work surface 104, a strap chute 106, a strapping assembly 110, and a motor assembly 112. The strapping machine may also include a user control 114 to provide automatic operation and control of the strapping machine 100. A strap, indicated at 108 is illustrated diagrammatically in the chute 106.

Figure 2:
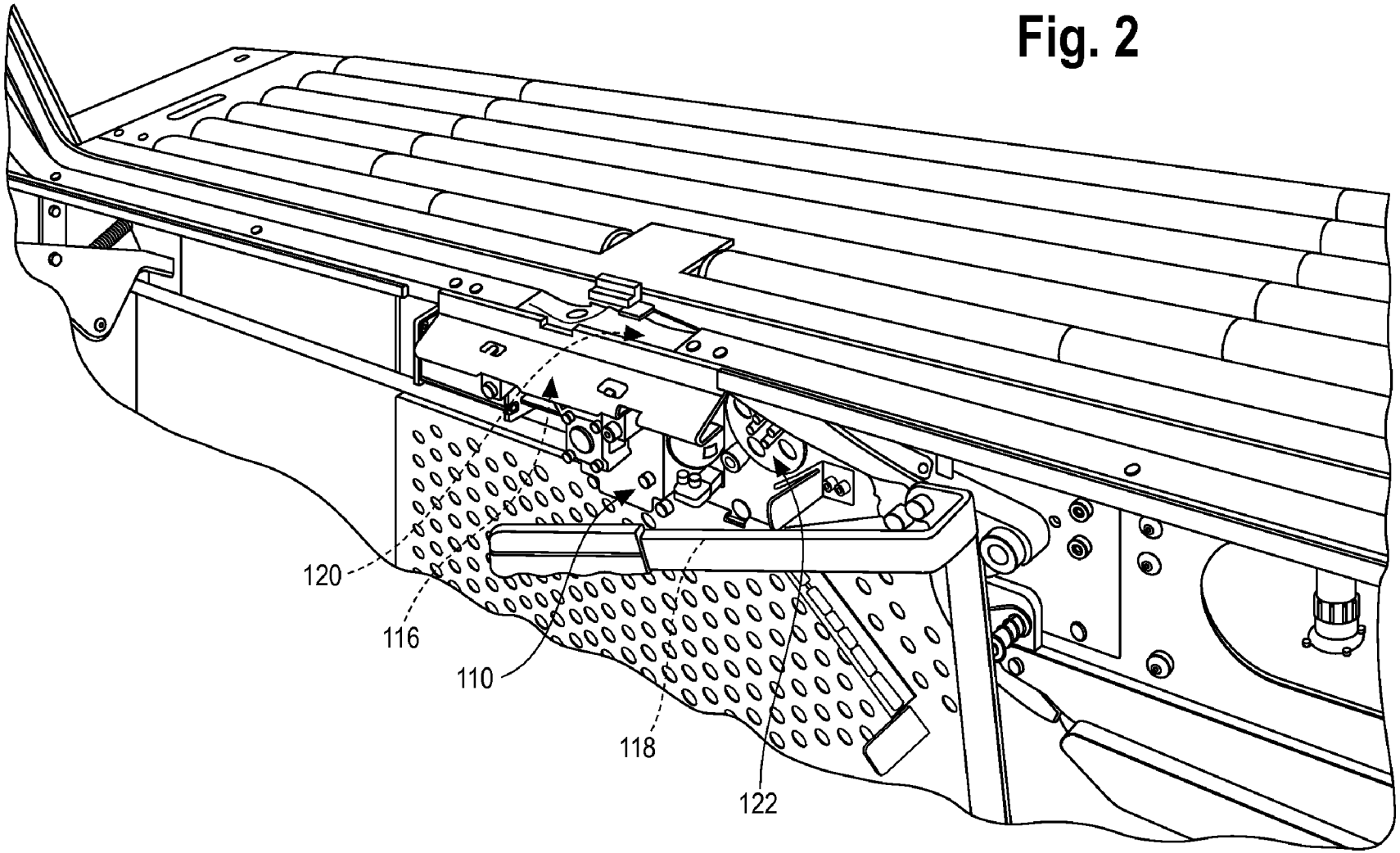
FIG. 2 illustrates a perspective view of one embodiment of a strapping assembly in the strapping machine in FIG. 1.

As shown in FIGS. 1 and 2, the strapping assembly 110 includes at least a gripping arrangement, 116, a cutter 118, and a sealing head 120. In general, when a load (not shown) to be strapped is placed on the work surface 104, the motor assembly 112 is energized to operate in a forward direction. This drives a feed/tension wheel 122 which feeds the strap 108 from a strap supply or dispenser, through the strapping assembly 110, around the strap chute 106, and back to the strapping assembly 110. Once the strap 108 has reentered the strapping assembly 110, the gripping arrangement 116 grips the strap 108, and the motor assembly 112 is energized in the reverse direction (rotating the wheel 122 in the reverse direction), causing the strap 108 to be stripped from the strap chute 106 and taken up around the load. The strap 108 is then tensioned around the load. Once tensioned, the strap 108 is gripped and the motor assembly 112 is turned off. The cutter 118 in the strapping assembly 108 then cuts the strap 108 and the sealing head 120 forms a seal between the two overlying portions of the strap 108, sealing the strap 108 to itself around the load.

Figure 3:
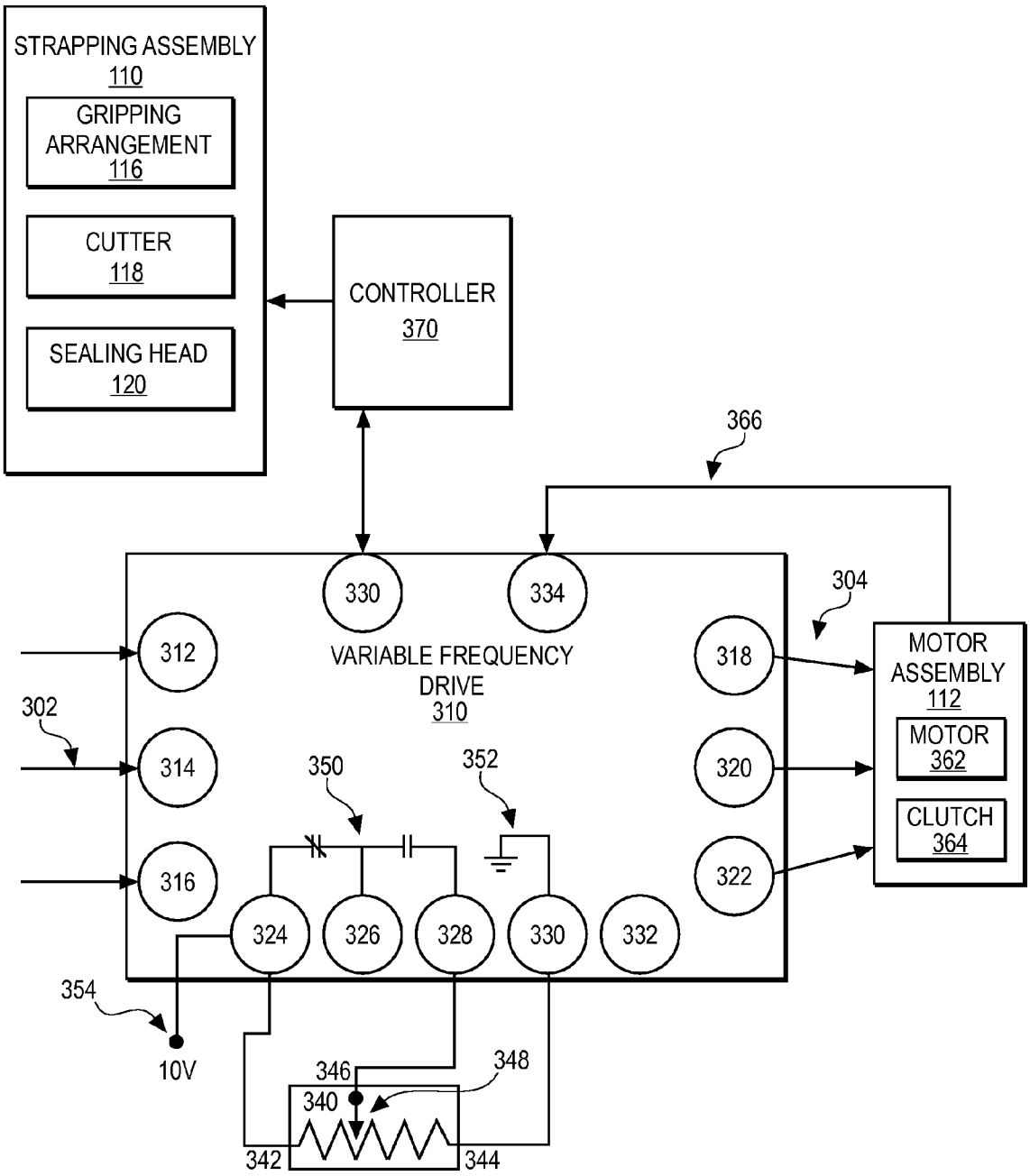
FIG. 3 illustrates one embodiment of a tension control system according to the present invention.

FIG. 3 shows one embodiment a tension control system 300 that may be used to tension the strap 108 around the load according to the present invention. The tension control system 300 includes an adjustable speed drive (ASD) 310, a voltage divider 340, and a controller 370.

In one embodiment, the ASD 310 is a variable frequency drive designed to control the torque applied by the motor assembly 112 when tensioning the strap around the load. Generally, the ASD 310 receives AC power, converts the AC power to a DC intermediate power, and then converts the DC intermediate power to a quasi-sinusoidal AC power that is used to drive the motor assembly 112. In one exemplary embodiment, the ASD 310 may be an Allen Bradley PowerFlex 70® AC Drive, although it is understood that other commercially available ADSs may also be used.

The ASD 310 includes three power input terminals 312-316 for receiving a three-phase AC power signal 302 and three power output terminals 318-322 for outputting a three-phase quasi-sinusoidal AC power signal 304 to drive the motor assembly 110. While not shown in FIG. 3, each of the three power input terminals 312-316 may be connected with either input fuses or an input circuit breaker. The input three-phase AC power signal 302 and the output three phase quasi-sinusoidal AC power signal 34 are also preferably transmitted using shielded or unshielded multi-conductor cables The ASD 310 also includes a control terminal connected to the controller 370, a negative reference terminal 330, a positive reference terminal 332, and three terminals 324-328 used for selecting an input signal to be applied to the reference terminal 332. As will be discussed in more detail below, the amount of torque applied by the motor assembly 112 is controlled based on the signals received at the negative and positive reference terminals 330 and 332, and more particularly, by altering the voltage potential and/or current applied to the negative and positive terminals 330 and 332.

The ASD may also include a torque feedback input 334 operably connected to the motor assembly 112 for receiving a torque feedback signal 366 regarding the amount of torque being applied by the motor assembly 112 to the strap during tensioning.

The voltage divider 340 is preferably a three-terminal resistor (also referred to as a potentiometer) having a wiper 348 that is manually adjustable to different spots along the resistor. As the wiper 348 is adjusted, the resistance between the wiper 348 and one terminal 342 and 344 gets smaller while the resistance between the wiper and the other end gets larger. Accordingly, the wiper 348 can be adjusted to provide a specific attenuated voltage between a minimum voltage applied to one terminal and a maximum voltage applied to the other terminal.

In one embodiment, a first terminal 344 of the voltage divider 340 is connected to terminal 330 of the ASD 310, which is also preferably connected to a ground 352. A second terminal 342 of the voltage divider 340 is then connected to terminal 324 of the ASD 310, which is also connected to a reference voltage 354, for example 10V. A third terminal 346 of the voltage divider 340 is connected to the wiper 348 and to terminal 328 of the ASD 310.

A switch 350, such as, for example, a form C contact, may then be provided among terminals 324-328 of the ASD 310. The switch 350 is normally open between terminals 326 and 328, and normally closed between terminals 324 and 326. As a result, when not energized, the 10V reference voltage (i.e. the "maximum voltage") at terminal 324 is applied to terminal 326 and in turn, terminal 332. When energized, the switch 350 becomes closed between terminals 326 and 328, and open between terminals 324 and 326. As a result, the attenuated voltage from the wiper 348, which is connected to terminal 328, is applied to terminal 326 and in turn, terminal 332.

The controller 370 is preferably a programmable logic controller configured to control the ASD 310. The controller 370 is also operably connected to the strapping assembly 110 to send and receive information and control signals to and from the strapping assembly. Although the controller 370 is illustrated as a separate unit from the ASD, the controller 370 may also be built-in or internal to the ASD. The controller 370 may also be comprised of several separate controllers.

The motor assembly 112 is driven by the three-phase power signal 304 output by the ASD 310, and is preferably comprised of an induction motor 362 and a tension clutch 364 that may be operably engageable with the motor 362. When actuated, the motor 362 drives a feed wheel, windless or similar apparatus in the strapping machine 100 to feed the strap 108 around the strap chute 106, take up the strap 108 around a load, and then tension the strap 108 around the load. The tension clutch 364 is preferably engaged only during the tensioning process.

While one specific embodiment of the tension control system is illustrated in FIG. 3, one of ordinary skill in the art would understood that various modifications to the system may be made without departing from the spirit and scope of the present invention. For example, the voltage divider 340 may be any known type of device or circuit capable of providing both a maximum voltage and an attenuated voltage. For example, a varistor may be used rather than a potentiometer. External adjustable voltage or current supplies may also be used. Accordingly, the present invention is not meant to be limited to any one particular means for providing the reference voltage and the attenuated voltage to the ASD.

Various types of adjustable speed drives may also be used. The adjustable speed drive may have a single-phase input rather than a three-phase input, and may also be configured to drive other types of motors other than induction motors. The adjustable speed drive may also include additional terminals not illustrated in FIG. 3. Depending on the specific ASD used, the applied torque may be controllable using methods other than a voltage divider or a reference input signal.

Figure 4:
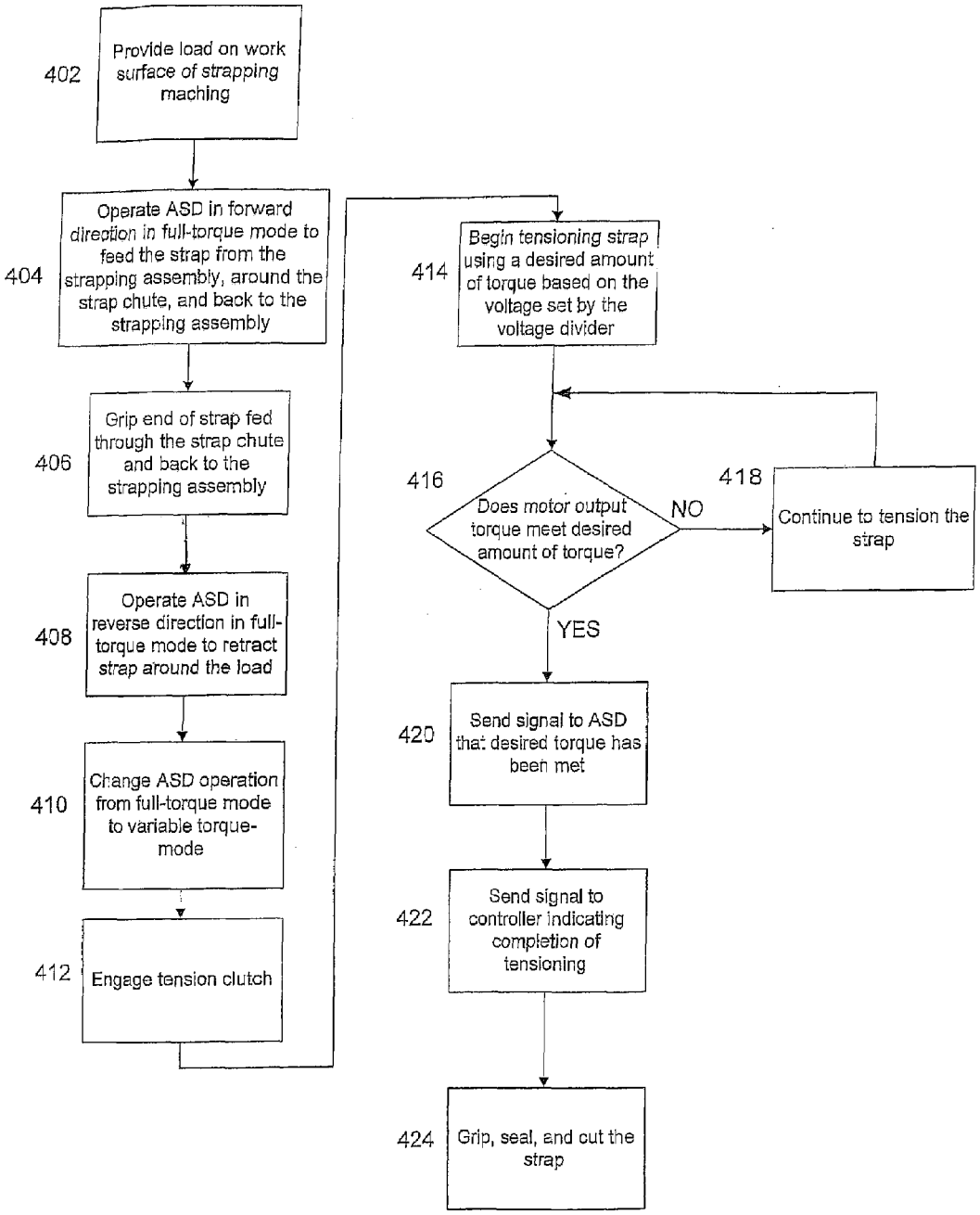
FIG. 4 illustrates one embodiment of a process for tensioning a strap around a load using the tension control system of FIG. 3.

FIG. 4 illustrates one method for tensioning a strap using the tension control system of FIG. 3. In step 402, a load is provided on the work surface 104 of the strapping machine 100. In step 404, to feed the strap 108 around the strap chute 106, the controller 370 instructs the ASD 310 to operate in a forward direction in a full-torque mode. In the full-torque mode, the switch 350 is not energized, and therefore the 10V reference voltage is applied to the positive reference terminal 332 of the ASD310, and the ASD 310 actuates the motor assembly 112 to apply a predetermined full torque to the strap 108.

Once the strap 108 is fed around the strap chute 106 and back into the strapping assembly 110, the strap 108 is gripped (step 406) and the ASD 310 is instructed by the controller 370 to operate in a reverse direction in the full-torque mode (step 408). The ASD 310 will continue to drive the motor assembly 112 in the full-torque mode until the strap 108 is taken up around the load. In one embodiment, the tension clutch 364 is not engaged during steps 404-408.

One the strap 108 is taken up around the load, the controller 370 instructs the ASD 310 to change from full-torque mode to a variable-torque mode (step 410). In the variable torque mode, the switch 350 is energized and therefore, the attenuated voltage set by the wiper 348 of the voltage divider 340 is supplied to the positive reference terminal 332 of the ASD 310. In step 412, the tension clutch 364 is engaged, and in step 414, the ASD 310 actuates the motor assembly 112, preferably in the reverse direction, to begin tensioning the strap 108 using an amount of torque set based on the attenuated voltage input to the positive reference terminal 332. It should be understood that since different embodiments and types of loads may require different amount of torque for sufficient tensioning, the attenuated voltage may be adjusted for each different embodiment or load.

In step 416, it is determined whether the torque output from the motor assembly 112 meets the desired torque set by the ASD 310. In one embodiment, this is accomplished by monitoring the torque applied by the motor assembly 112 using a sensor, or any other type of torque monitoring circuit. The motor assembly 112 may then be configured to either continuously transmit the torque feedback signal to the controller 370, or alternatively, to transmit the torque feedback signal to the controller 370 only upon the desired amount of torque being met.

If the motor output torque has not reached the desired torque, then the motor assembly 112 continues to tension the strap 108 around the load (step 418). If motor output torque has reached the desired torque, then a torque feedback signal 366 is transmitted from the motor assembly 112 to the ASD 310, informing the ASD 310 that the desired torque has been met (step 420). In step 422, the ASD 310 sends a signal to the controller 370 informing the controller that the tensioning process has been completed. In step 424, the controller 370 instructs the strapping assembly 110 to grip, seal, and cut the strap.

As a result of the aforementioned system and method, tensioning of the strap around the load in a strapping machine may be accomplished by adjusting the torque applied by the motor assembly and reporting back to the adjustable speed drive once the desired amount of torque has been achieved. Therefore, the tension clutch does not slip during tensioning.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the claims.

What is claimed is:

1. A strapping machine configured to feed a strap around a load, position, tension and seal the strap around the load, the strapping machine comprising:

a surface to support the load in the strapping machine;

a strap chute to carry a strap around the load and release the strap from the strap chute;

a motor assembly to convey the strap around the strap chute, retract the strap material around the load, and tension the strap around the load, the motor assembly having a motor and a tension clutch operably engageable with the motor, the tension clutch engaged with the motor only during a tensioning process;

an adjustable speed drive capable of receiving a first reference signal and a second reference signal, and configured to actuate the motor assembly to apply a first amount of torque to the strap when receiving the first reference signal and to apply a second amount of torque to the strap when receiving the second reference signal; and a controller configured to send the first reference signal to the adjustable drive to operate the adjustable speed drive in a first mode while conveying the strap around the strap chute and retracting the strap material around the load, and configured to send the second reference signal to the adjustable drive to operate the adjustable speed drive in a second mode while tensioning the strap around the load, wherein in the first mode, the adjustable speed drive actuates the motor assembly to apply the first amount of torque to the strap, and in the second mode, the adjustable speed drive actuates the motor assembly to apply the second amount of torque to the strap.

2. The strapping machine of claim 1 wherein the adjustable speed drive is a variable frequency drive.

3. The strapping machine of claim 2 further including a voltage divider coupled to the adjustable speed drive, wherein the second reference signal comprises an attenuated voltage provided by the voltage divider.

4. The strapping machine of claim 3 wherein a minimum voltage is applied to a first terminal of the voltage divider, a maximum voltage is applied to a second terminal of the voltage divider, and wherein the first reference signal is the maximum voltage and the attenuated voltage is a voltage between the minimum and maximum voltages.

5. The strapping machine of claim 4 further comprising a switch for selecting between the maximum voltage and the attenuated voltage.

6. The strapping machine of claim 5 wherein the voltage divider is a potentiometer.

7. The strapping machine of claim 6 wherein the motor assembly is further configured to transmit a torque feedback signal to the adjustable speed drive indicative of the amount of torque being applied by the motor assembly to the strap.

8. The strapping machine of claim 7 wherein, upon receiving the torque feedback signal indicating that the motor assembly has applied the second amount of torque to the strap, the adjustable speed drive is configured to send a tension complete signal to the controller indicating that tensioning of the strap has been completed.

9. The strapping machine of claim 8 wherein, upon receiving the tension complete signal, the controller is configured to actuate a strapping assembly to grip the strap, seal the strap onto itself, and cut the strap.

10. A tension control system for a strapping machine having a strapping assembly, the strapping machine configured to feed a strap around a load, position, tension and seal the strap material around the load, the tension control system comprising:

a motor assembly to convey the strap around a strap chute, retract the strap around the load, and tension the strap around the load, the motor assembly having a motor and a tension clutch, the tension clutch engaged with the motor only during a tensioning process;

an adjustable speed drive capable of receiving a first reference signal and a second reference signal, the adjustable speed drive being configured to actuate the motor assembly to apply a first amount of torque to the strap when receiving the first reference signal and to apply a second amount of torque to the strap when receiving the second reference signal; and a controller configured to send the first reference signal to the adjustable drive to operate the adjustable speed drive in a first mode while conveying the strap around the strap chute and retracting the strap material around the load, and configured to send the second reference signal to the adjustable drive to operate the adjustable speed drive in a second mode while tensioning the strap around the load, wherein in the first mode, the adjustable speed drive actuates the motor assembly to apply the first amount of torque to the strap, and in the second mode, the adjustable speed drive actuates the motor assembly to apply the second amount of torque to the strap.

11. The tension control system of claim 10 wherein the adjustable speed drive further includes a first drive terminal, a second drive terminal, a third drive terminal, a negative reference terminal, and a positive reference terminal.

12. The tension control system of claim 11 further comprising a voltage divider having a first voltage divider terminal coupled to the first drive terminal, a second voltage divider terminal coupled to the negative reference terminal, and a third voltage divider terminal coupled to the third drive terminal.

13. The tension control system of claim 12 wherein the first voltage divider terminal is coupled to a maximum voltage, the second voltage divider terminal is coupled to a minimum voltage, and the third voltage divider terminal provides an attenuated voltage between the minimum and maximum voltages.

14. The tension control system of claim 13 wherein the second drive terminal is coupled to the positive reference voltage, and the first and third drive terminals are coupled to the second drive terminal via a switch such that, at any one time, the second drive terminal is connected to only one of the first and third drive terminals.

15. The tension control system of claim 14 wherein the switch is a form C connector.

16. The tension control system of claim 10, wherein the tension clutch is engaged with the motor when the adjustable speed drive is operating in the second mode.

17. The tension control system of claim 16 wherein the tension clutch is not engaged with the motor when the adjustable speed drive is operating in the first mode.

18. The tension control system of claim 10 wherein the motor assembly is further configured to transmit a torque feedback signal to the adjustable speed drive indicative of the amount of torque being applied by the motor assembly to the strap.

19. The tension control system of claim 18 wherein, upon receiving the torque feedback signal indicating that the motor assembly has applied the second amount of torque to the strap, the adjustable speed drive is configured to send a tension complete signal to the controller indicating that tensioning of the strap has been completed.

20. The tension control system of claim 19 wherein, upon receiving the tension complete signal, the controller is configured to actuate the strapping assembly to grip the strap, seal the strap onto itself, and cut the strap.

* * * * *

UNITED STATES PATENT AND TRADEMARK OFFICE

CERTIFICATE OF CORRECTION

PATENT NO. : 7,454,877 B2
APPLICATION NO. : 11/535372
DATED : November 25, 2008
INVENTOR(S) : Arland Morrison It is certified that error appears in the above-identified patent and that said Letters Patent is hereby corrected as shown below:

Claim 1, Column 6, Line 22 should read, "the adjustable speed drive to operate the adjustable speed drive"

Claim 1, Column 6, Line 26 should read, "adjustable speed drive to operate the adjustable speed drive in"

Signed and Sealed this

Tenth Day of February, 2009

JOHN DOLL
*Acting Director of the United States Patent and Trademark Office*